US006184496B1

(12) United States Patent
Pearce

(10) Patent No.: US 6,184,496 B1
(45) Date of Patent: Feb. 6, 2001

(54) DRIVEWAY, WALKWAY AND ROOF SNOW AND ICE MELTING MAT

(75) Inventor: Richard J. Pearce, Golden, CO (US)

(73) Assignee: Clearpath, Inc., Aurora, CO (US)

( * ) Notice: Under 35 U.S.C. 154(b), the term of this patent shall be extended for 0 days.

(21) Appl. No.: 09/583,682

(22) Filed: May 31, 2000

Related U.S. Application Data

(63) Continuation-in-part of application No. 09/129,965, filed on Aug. 6, 1998.

(51) Int. Cl.[7] ..... H05B 1/00

(52) U.S. Cl. ..... 219/213; 219/202; 219/212; 219/528

(58) Field of Search ..... 219/200, 202, 219/212, 213, 520, 528, 529, 535, 537, 538, 539, 541, 542, 543, 545, 549

(56) References Cited

U.S. PATENT DOCUMENTS 3,806,702 * 4/1974 Spencer ..... 219/528
3,878,362 * 4/1975 Stinger ..... 219/528
3,900,654 * 8/1975 Stinger ..... 219/528
4,251,712 * 2/1981 Parr ..... 219/213
4,323,607 * 4/1982 Nishimura et al. ..... 219/213
4,485,297 * 11/1984 Grise et al. ..... 219/528
4,564,745 * 1/1986 Deschenes ..... 219/213
4,967,057 * 10/1990 Bayless et al. ..... 219/213
5,003,157 * 3/1991 Hargrove ..... 219/213
5,395,179 * 3/1995 Kotani ..... 219/213
5,591,365 * 1/1997 Shields ..... 219/213
5,605,418 * 2/1997 Watanabe et al. ..... 219/528
5,614,292 * 3/1997 Saylor ..... 219/528
5,637,247 * 6/1997 Flynn, Jr. ..... 219/213
5,932,128 * 8/1999 Dishop ..... 219/505

* cited by examiner

*Primary Examiner*—Tu Ba Hoang
(74) *Attorney, Agent, or Firm*—Dennis G. LaPointe; Mason & Associates, PA

(57) ABSTRACT

A relatively lightweight and easy to use flexible heating mat for melting snow and ice that can be cut in the field to custom length or to accommodate direction changes or avoid obstructions. The heating mat includes one or more planar flexible heaters sandwiched between two vulcanized polymer protective sheets. The heating mat may be activated remotely or manually and can be powered from either end of the heating mat. Nonskid patterns ate typically included in heating mats used on driveways and walkways.

62 Claims, 18 Drawing Sheets

DRIVEWAY, WALKWAY AND ROOF SNOW AND ICE MELTING MAT

RELATED APPLICATION

This application is a continuation-in-part of U.S. patent application Ser. No. 09/129,965 filed Aug. 6, 1998.

BACKGROUND OF THE INVENTION

1. Field of the Invention

The invention relates to flexible heating mats for melting snow and ice on driveways, walkways, including stairs, and roofs.

2. Description of Related Art

Over the years there have been a number of attempts to melt snow and ice accumulations by heating the affected surface. Most past configurations required a permanent installation of the heating element inside the surface, as exemplified by Watanabe in U.S. Pat. No. 5,605,418 and Deschenes in U.S. Pat. No. 4,564,745. These solutions however tend to be expensive, are not readily adaptable to existing surfaces, and maintenance and repair often require destruction and reconstruction of the protected surface.

Several attempts at melting snow and ice accumulations by placing a heater on the surface of the area to be cleared have been made, as discussed below. Bayless et al., U.S. Pat. No. 4,967,057 teaches the use of multiple individual panels to cover varying size areas. The Bayless patent however calls for multiple connections between the separate panels, presenting potential failure points. Additionally the panel may be dislocated or disconnected when driven upon. Bayless also requires a large number of panels to cover large areas and thus is not desirable for installation on driveways. In fact, Bayless discloses that the panels are appropriate to steps and walkways only.

Another attempt by Shields, in U.S. Pat. No. 5,591,365 addresses those concerns by placing the heating element in a flexible lattice form. However, Shields uses a single series resistive element in the form of specialized and expensive heating cables distributed throughout the lattice. The use of a single series heating element prevents field customization of the heater to fit varying length of protected areas, and reduces reliability since a break in any point along the heater will render the whole apparatus inoperative.

Similar patents include U.S. Pat. No. 5,614,292 to Saylor, U.S. Pat. No. 5,003,157 to Hargrove, U.S. Pat. No. 3,806,702 to Spencer, and U.S. Pat. No. 5,637,247 to Flynn, Jr. Patents, such as U.S. Pat. No. 3,900,654 to Stinger have described heater elements allowing trimming to any desired length, comprising a thin, flexible laminated assembly of electrically conductive elastomeric material. U.S. Pat. No. 4,523,085 to Grise teaches flexible sheet film heating elements that comprises current feed electrodes, heretofore referred to as bus bars, disposed in parallel along two sides of the heater film. Multiple resistive ink patterns traversely connect between the bus bars to form an array of parallel connected heater elements. This arrangement allows for field customization of the heater length since the film heater may be cut anywhere between the parallel connected heating elements. However the Grise heater is not durable enough to sustain people or vehicular traffic or prolonged exposure to elements such as ultraviolet light, ozone, sand and chemicals. Additionally when cut, the Grise heater does not offer submersion protection since the bus bars are exposed at the cut end.

All the above, taken individually or in combination do not teach the current invention as claimed. An inexpensive solution to the problem of snow removal by electrical means that is easy to install by untrained personnel, and that may be sold in roll form to allow cutting for any desired length in the field is therefor clearly highly desirable and is presented in the instant invention.

SUMMARY OF THE INVENTION

The present invention is a heating mat for melting snow and ice. It has at least one planar flexible electric heater, each of which includes a first elongated, flexible, electrically insulating substrate which has an electrically insulated surface.

The planar flexible heater further includes a plurality of resistive heating elements comprising a plurality of resistive material traces deposited on the first insulating substrate in a spaced apart relationship. In addition, a first and second electrical conductor is each disposed in proximity to each of respective opposing edges of the electric heater, and a third electrical conductor is disposed at an intermediate location between the first and second electrical conductor. Each of the resistive material traces are in electrical communication with the first, second and third electrical conductors and extend therebetween.

In another embodiment, in lieu of applying a plurality of parallel resistive traces, a uniform layer of resistive material trace is applied to the surface of the first insulating substrate.

The planar flexible heater further includes a second elongated, flexible, electrically insulating substrate having an electrically insulated surface, wherein the first insulating substrate is adhesively attached to the second insulating substrate with the resistive elements and electrical conductors disposed therebetween. The first insulating substrate and the second insulating substrate form the flexible electric heater's two opposite planar surfaces.

The flexible electric heater is sandwiched between two protective sheets composed of abrasion resistant flexible material. Each protective sheet has an inner surface oriented towards and in face to face adherent engagement with the respective planar surfaces of the flexible electric heater. The two protective sheets and electric heater disposed therebetween form the heater mat which has two opposing end edges, and two opposing side edges.

A novel advantage of the present invention is that the resistive heating traces and electrical conductors are arranged such that a portion of the heating mat may be removed or cut away to accommodate a use by cutting the heating mat to remove an unwanted or interfering portion. With a portion of the heating mat cut away, the heating mat nevertheless is capable of maintaining its electrical operative characteristics despite removal of the cut away portion of the heating mat.

In another embodiment of the present inventive heating mat, the planar flexible heater may further include a grounding metallic substrate which is in a laminar relationship with the first insulating substrate. The grounding metallic substrate is adhesively attached to the first insulating substrate.

Each of the first, second and third electrical conductor is typically an elongate strip made of copper or a copper alloy. In a preferred application of the present invention, where a copper strip may be relatively stiff and may cause some separation between the conductor and the resistive material traces when flexing the heater, an elongate conductive film may be disposed between each of the first, second and third electrical conductors and the first insulating substrate. The elongate conductive film may be a thin layer or coating of silver or a silver alloy.

A practical way to bond the respective inner surfaces of the protective sheets onto the respective planar surfaces of the electric heater is by spraying a pressure sensitive hot melt adhesive on one of the respective planar surfaces of the electric heater or on one of the corresponding mating inner surfaces of the protective sheets.

Because the present invention is intended to be used on driveways, in such applications, it is preferred that at least one of the protective sheets includes an outer surface with a nonskid pattern impressed thereupon. For example, a non-skid pattern may include a plurality of ribs protruding therefrom, wherein the ribs form a cyclic V-pattern extending transversely to the side edges of the heating mat and the ribs further form drainage channels in the spaces therebetween. Such a pattern is commonly referred to as a "Chevron" pattern. Of course, other patterns may be used, including a straight transverse oriented V-pattern or a series of random embossed raised portions like that found in safety diamond plate. Such non-skid patterns would not be necessary when the present invention is installed on roof edges at or near the shingle drip edge flashing. Further, in some applications, the non-skid pattern may not be necessary for some stairs, staggered steps or surfaces and other walkways. In roof applications, one of the protective sheets that would typically be oriented toward the sky, can be made from synthetic or standard roofing materials, including shingles, wooden shakes or tar paper base or similar shingle materials, or single coverage rolled roofing materials. In such cases, the roofing material used for the protective sheet may be made to aesthetically blend in with existing roofing materials, including appropriate color coordination to match roof colors.

As an energy saver, the present invention may include a thermal cutout switch electrically connected in series with the flexible electric heater.

As an additional control as well as safety feature, it is recommended that the present invention further include a ground fault circuit interrupter (GFCI) or an equipment leakage circuit interrupter (ELCI), as appropriate, which is electrically connected in series with the flexible electric heater. The interrupter is preferably located in an electrical power supply cable or cord for connecting the heating mat to a source of electrical power.

In order to prevent inadvertent fraying or wear and tear on the opposing side edges of the heating mat, the two opposing side edges of the heating mat may be bound by stitching an elongate substantially or generally water and mildew resistant material, such as a nylon, cotton, polyester web material, combinations thereof, or similar web material, to each of the opposing side edges, in the same manner that a person may finish the edges of a throw carpet.

The first and second insulating substrates are typically made from a thermoplastic laminate material or polyester based carrier. The adhesive bonding material may be a polyethylene based adhesive material.

To finish the opposing end edges of the heating mat, the present invention includes an elongated sealing bracket with a substantially U-shaped cross section that forms an elongated opening dimensioned to receive each of the opposing end edges of the heating mat within the opening. This feature protects the opposing end edges and protects the electrical connections located at one of the opposing end edges for connecting the at flexible electric heater to a source of electric power.

The elongated sealing bracket is attached with sealing means for bonding each end edge of the heating mat and for encapsulating each end edge thereby preventing submersion, exposure from weather hazards, and injury due to electrocution. The sealing means is typically a pressure sensitive hot melt adhesive. In addition, a butyl rubber based adhesive tape may be used to encase the exposed end of the electric heater where the electrical connections are made after the hot melt adhesive is applied and before the sealing bracket is applied. Additionally, a tar-like sealant/adhesive may be applied along the inside edges of the bracket for additional weather-proofing.

The heating mat further includes means for connecting the source of electric power from either side edge of the elongated sealing bracket protecting the electrical connections.

The present invention may include an array of a plurality of electric heaters to be sandwiched between one set of protective sheets. For example, a typical application of the present invention would manufacture electric heaters which are approximately one foot wide. This size mat may be ideal for roof edges or narrow stairways and steps. However, the heating mats may as easily be made to accommodate any desired width, such as about 1–5 feet wide, by making a heating mat incorporating 1–5 heaters. This would render the invention ideal for driveways and wider walkways. The multiple electric heaters in these embodiments would be arranged parallel to each other. Of course, a single heater may be incorporated into any width heater mat. For example, a three foot heater mat may have an approximate three foot wide single heater incorporated within.

The protective sheets for the heating mat is generally made from a rubber based material, although other materials may be used, such as standard roofing materials for the protective sheet oriented toward the sky in roof applications. In order to increase the durability of the heating mat, it is recommended that the protective sheets be reinforced by fibrous or woven material, such as cotton, nylon, polyester, fiberglass, polymeric fibers, or similar fiber materials, embedded therein, or similar materials that can be woven within the base material.

The heating mat according to the present invention, further includes means for securing and for providing positional stability of the heating mat on a surface to be protected from snow and ice. This is typically grommets spaced along the edges of the heating mat through which appropriate fasteners may be used to position the heating mat in place.

When a heating mat is to be located on a roof edge, the means for securing and providing positional stability of the heating mat on a surface to be protected from snow and ice further preferably includes at least one elongate metallic strap having a plurality of spaced-apart angularly directed slots. Each strap is of sufficient length to allow the strap to slide under the roofing shingles and to engage a roof shingle nail into one of said slots. Each strap further includes a plurality of apertures in a spaced-apart relationship along the length of said strap. The heating mat may be attached to the strap by placing a fastener through one of the apertures into one of the grommets, thereby securing the heating mat to the roof edge.

To further secure the heating mat to a roof edge, the means for securing and providing positional stability of the heating mat on a surface to be protected from snow and ice may further include at least one elastomeric strap, similar to a bungy cord, with connecting means at each end for connecting one end of the strap to one of the grommets and for connecting an opposite end of the strap to a predetermined portion of a building near the roof edge.

Of course, smaller heating mats may be linked together for installation or use on staggered steps or surfaces by electrically interconnecting the smaller heating mats.

The heating mat according to the present invention may be electrically activated or electrically deactivated by a manual switch in the power cord, preferably between the equipment leakage circuit interrupter and the source of electric power, or by a remote means wherein a radio signal transmitter and receiver may be incorporated. Typically the transmitter will be located at a convenient location for accessibility by a homeowner or facility operator, while the receiver will be installed in line between the source of electric power and the equipment leakage circuit interrupter.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
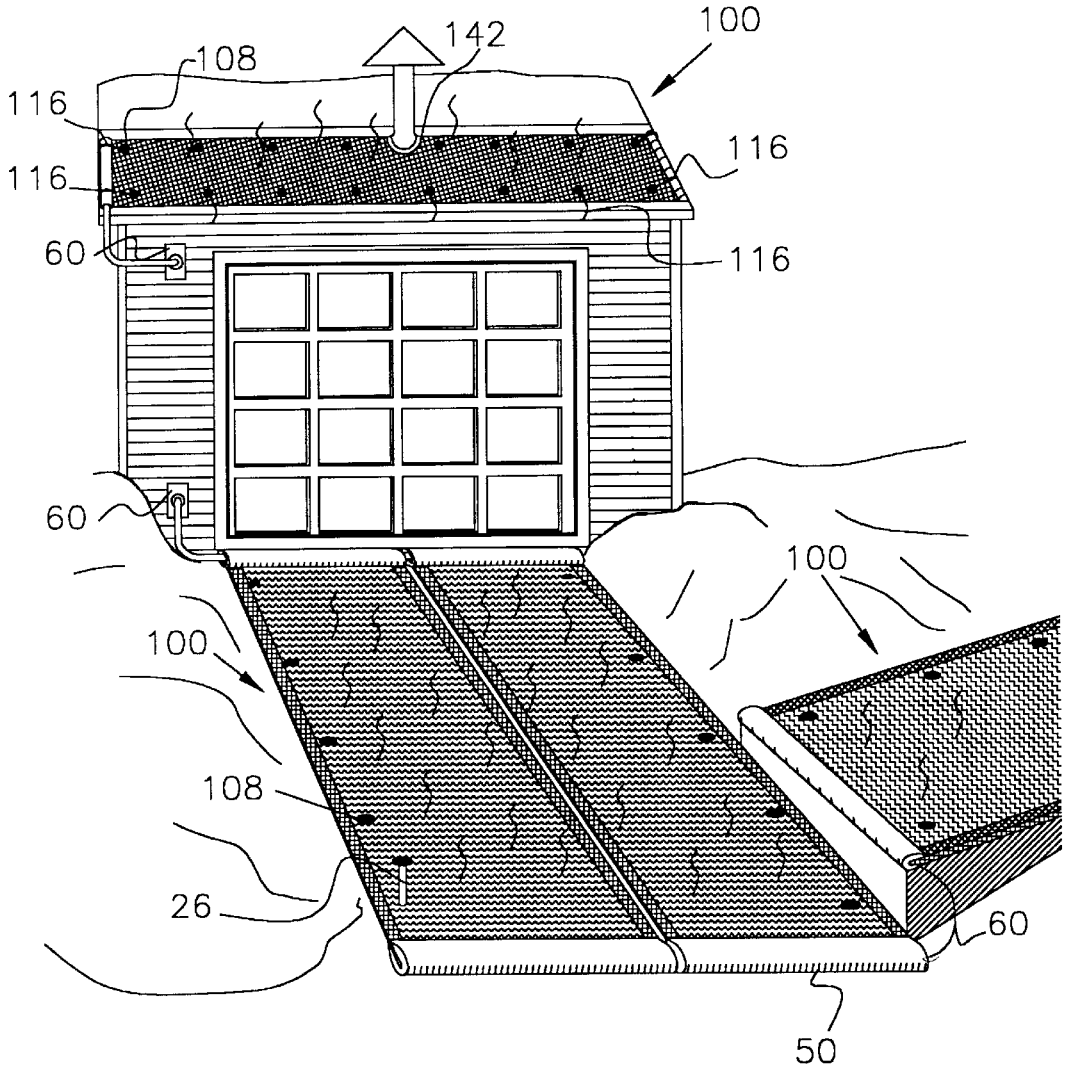
FIG. 1 is a perspective view of typical driveway, roof edge and walkway application of the invention.

Referring now to the drawings, in particular FIGS. 1–5, the invention which is a heating mat depicted generally as 100, comprises at least one planar flexible electric heater which includes a first elongated, flexible, electrically insulating substrate 12 having an electrically insulated surface; a plurality of resistive heating elements 24 comprising a plurality of resistive material traces 24 deposited on the first insulating substrate 12 in spaced apart relationship; a first and second electrical conductor 22, each disposed in proximity to each of respective opposing edges of said electric heater 10 and a third electrical conductor 22 disposed at an intermediate location between the first and second electrical conductor 22. Each of said resistive material traces 24 are in electrical communication with the first, second and third electrical conductors 22 and extending therebetween.

The planar flexible heater 10 further including a second elongated, flexible, electrically insulating substrate 14 having an electrically insulated surface, wherein the first insulating substrate 12 is adhesively attached to the second insulating substrate 14 with the resistive elements 24 and electrical conductors 22 disposed therebetween, the first insulating substrate 12 and the second insulating substrate 14 forming the at flexible electric heater's two opposite planar surfaces.

Two protective sheets 1,3 composed of abrasion resistant flexible material, each having an inner surface oriented towards and in face to face adherent engagement with the respective planar surfaces of the flexible electric heater 10 disposed between each protective sheet 1,3 form the heater mat 100 which has two opposing end edges and two opposing side edges.

The resistive heating traces 24 and electrical conductors 22 are arranged such that a portion of the heating mat 100 may be removed, as depicted at 142 in FIG. 1, to accommodate a use by cutting the heating mat 100 to remove the obstructing or interfering portion, while maintaining its electrical operative characteristics after removal of the portion. Should a pattern cut be made at a factory, it is understood that the cut away portion's edge would be finished at the factory. However, if the consumer cuts away a portion, it is recommended that the edge be further sealed with electrical sealants and tapes commonly available from most hardware stores or by using adhesives like hot glue and roofing tar and encasing the cut away edge with a tape, rubber or light plastic channel material before the adhesive cures.

In a typical application of the invention, heater 10 further includes a grounding metallic substrate in a laminar relationship with the first insulating substrate 104 which is adhesively attached to the first insulating substrate 12 on the planar side opposite the resistive material traces 24. Substrate 104 is typically made of aluminum or an alloy thereof.

The first, second and third electrical conductors 22 comprise an elongate strip which is typically made from either copper or a copper alloy. The copper conductor 22 is typically about ¾ inch wide with a thickness of about 10 mils.

Because a copper strip or bus bar has some inherent stiffness thereby causing some minor separation points with the resistive material traces 24, the efficacy of the conductor 22 contact area with the resistive material traces 24 may be increased by further including an elongate conductive film 102 disposed between each of the first, second and third electrical conductors 22 and the first insulating substrate 12 with the resistive material traces 24 imprinted thereon. This elongate conductive film 102 is typically made from silver or a silver alloy. Each film 102 of silver is typically about ¼ inch wide and about 0.5 mil thick.

The resistive material traces 24 typically comprise a conductive carbon ink which is typically sprayed on the substrate 12 using a process similar to a rotary silk-screening process. The thickness of the resistive material traces 24 is generally about 0.4 to 0.6 mil. The silver film 102 need not be as wide as the copper bus strip or conductor 22. A relatively narrow band of silver film 102 running along one or both edges of the conductors 22 and protruding slightly under the surface of the copper conductors 22 is satisfactory.

The substrates 12,14 can be made of thin film flexible electrically insulating polymeric material such as polyester or Kepton which is commercially available from DuPont of Wilmington, Del. Protective sheets 1,3 are typically made from an elastomeric material such as fiber reinforce rubber or rubber like vulcanized polymer. The protective sheets 1,3 seal and protect the heater 10 from exposure to the elements as well as provide for mechanical strength and durability.

The protective sheets 1,3 are typically adhesively laminated to the heater 10 using a pressure sensitive hot melt adhesive 118 which is generally sprayed on or otherwise applied by manual or automated manufacturing means to saturate the heater 10 planar surfaces before each protective sheet 1,3 is laminated to the heater 10.

Figure 2A:
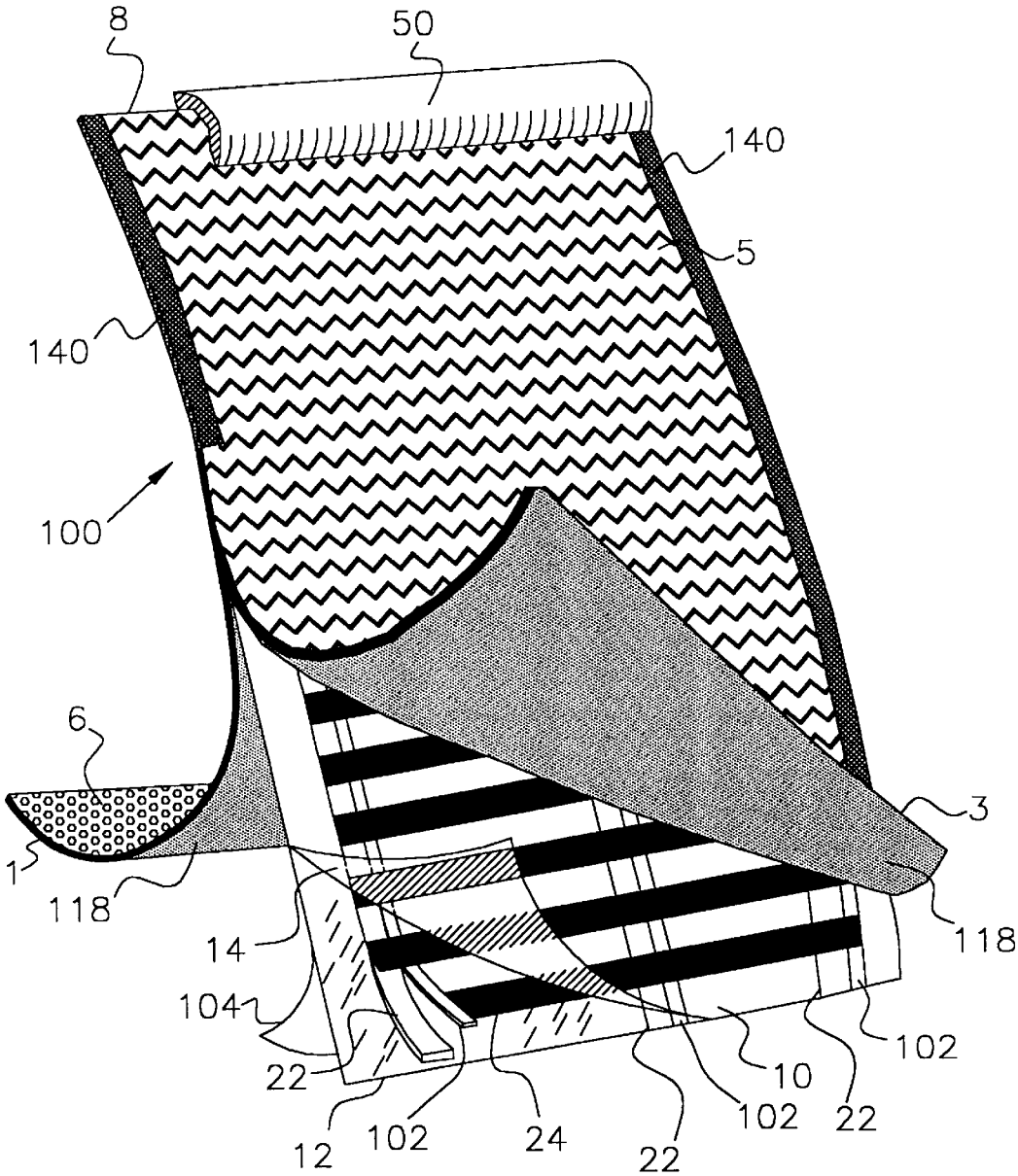
FIG. 2*a* is a perspective view of the invention depicting each layered component.
Figure 2B:
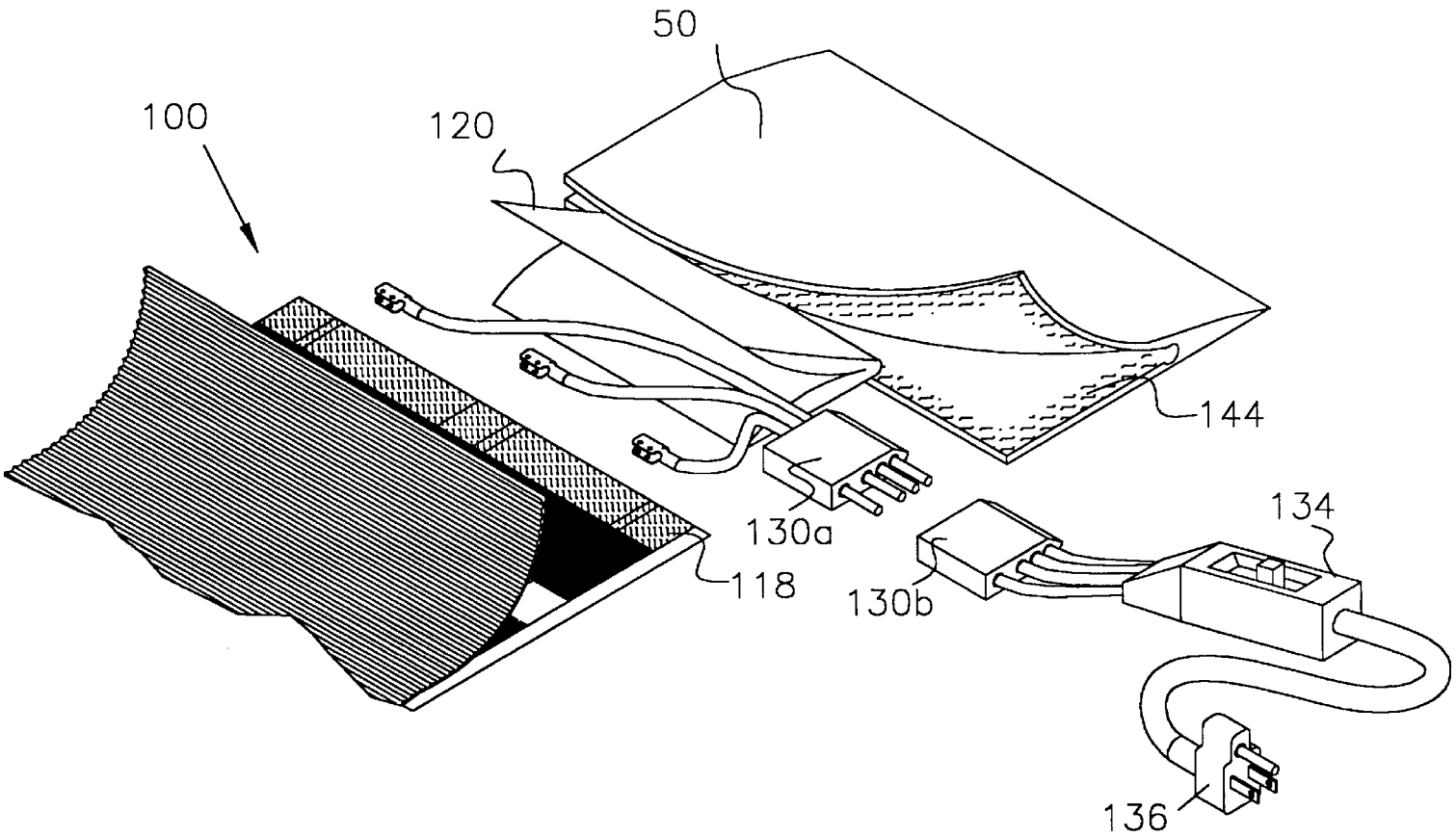
FIG. 2*b* is a perspective view of the typical components making up the electrical power connection end of the invention.
Figure 10:
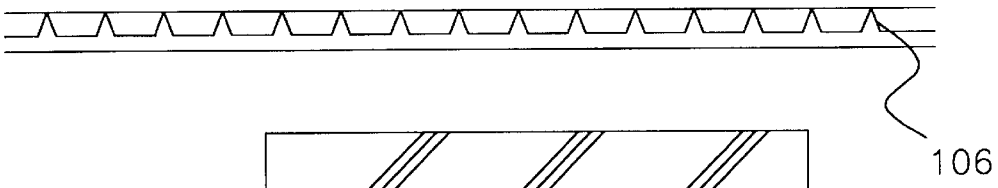
FIG. 10 is a cross-sectional view of a typical non-skid pattern of the heating mat.
Figure 11:
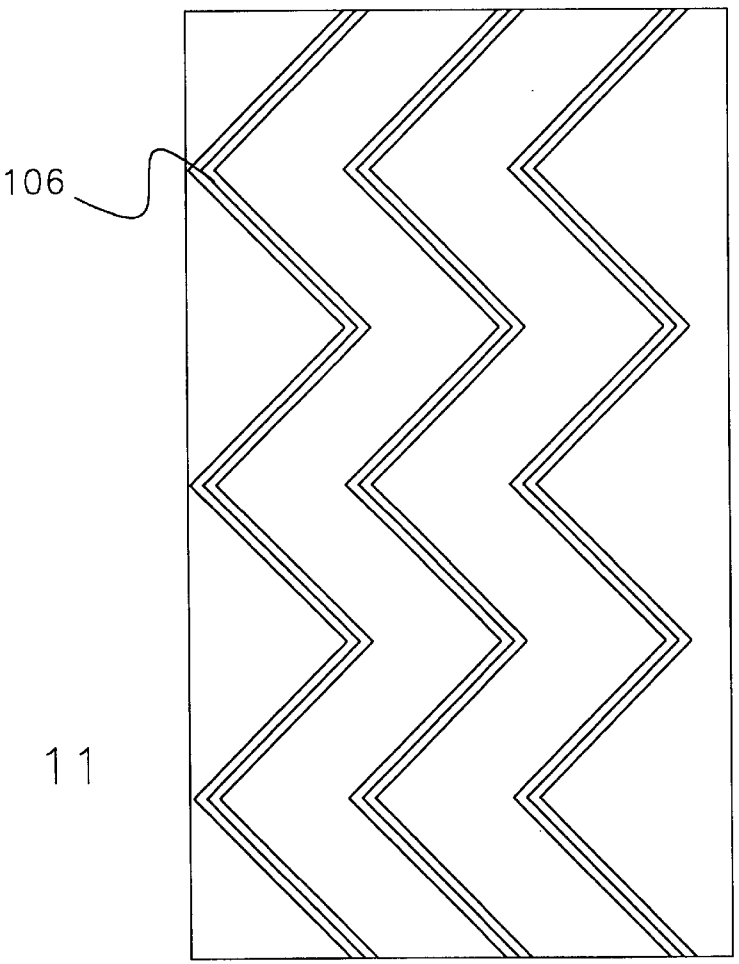
FIG. 11 is a plan view of the typical non-skid pattern of FIG. 10.

Protective sheet 1 with surface pattern 6 is typically applied to one side or both sides of the mat 100, except in applications such as driveways and roof edges, where a nonskid pattern 5 is recommended for the surface being walked on or being driven on, that is, protective sheet 3. It is recognized that the use of a rubber based material for protective sheet 1 with pattern 6 does have some minimal nonskid characteristics; however, more pronounced nonskid patterns 5, which may be straight lined V-shaped or cyclic V-shaped (Chevron shaped) with the valley area forming drainage channels 7, are preferred for driveways and walkways. Typically, this nonskid pattern 5 includes a plurality of ribs protruding therefrom, the ribs forming a cyclic V-pattern extending transversely to the side edges of the heating mat and the ribs further forming drainage channels in the spaces therebetween. FIG. 2*b* depicts a uniform series of straight line V-shaped ribs while FIGS. 1 and 2*a* depict typical "Chevron" shaped ribs. FIGS. 10 and 11 further depict this pattern with ribs 106. Other patterns may mimic star or diamond shape safety plate impressions or other generally acceptable safety nonskid patterns.

Figure 13A:
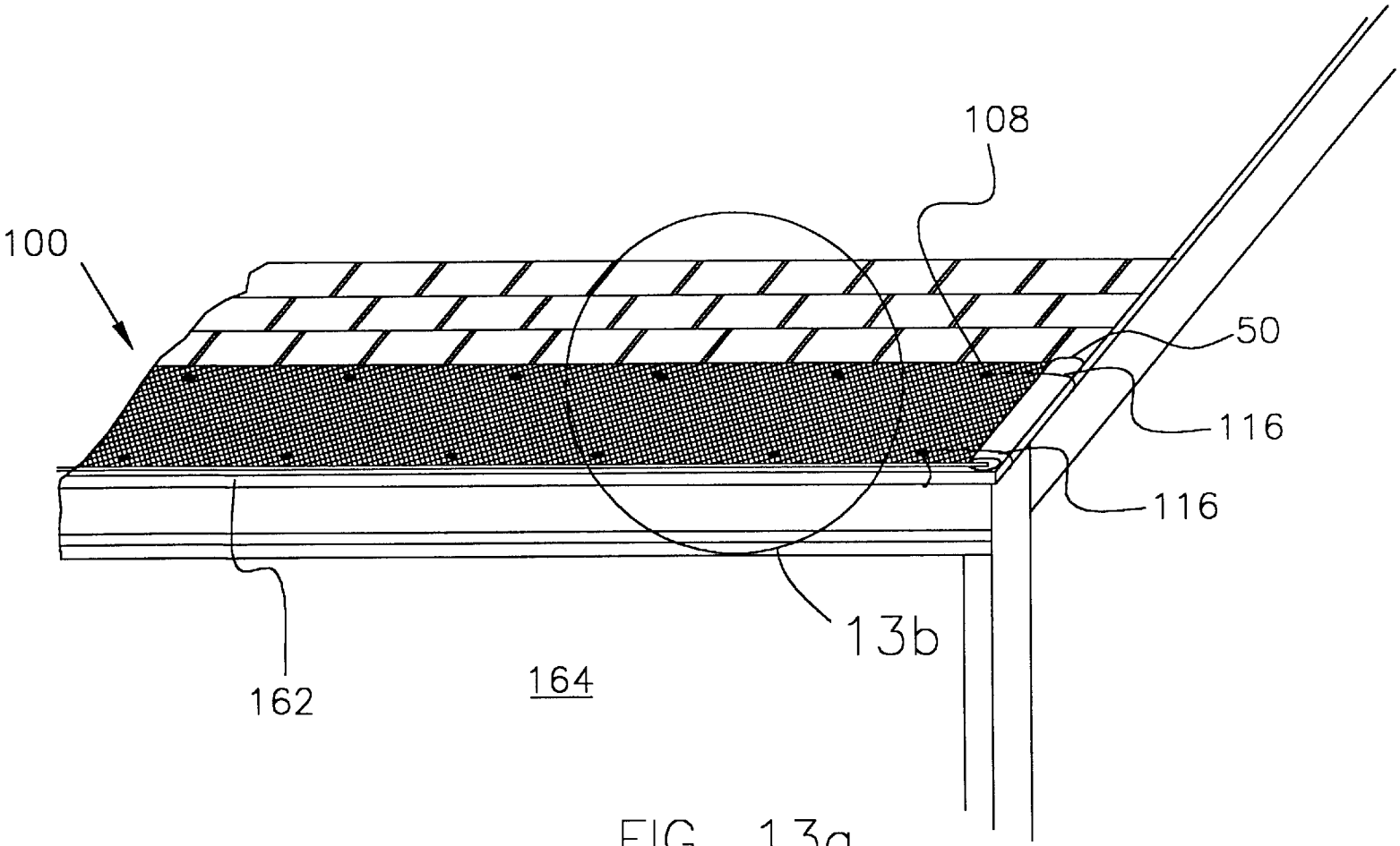
FIG. 13*a* is a perspective view depicting the use of the invention on a roof edge.

The present invention heating mat 100, when used on a roof edge such as depicted in FIGS. 1 and 13*a*, may have a nonskid protective sheet on one side of heating mat 100 which is made from a fiber-reinforced rubber base material or from a synthetic or standard roofing material, including shingles (wooden shakes or tar paper base or similar shingle materials), or single coverage rolled roofing materials, which has colored imbedded surface particulates which blend in to correspond to the color of typical roof colors, thereby improving the aesthetics of the roof line when heating mat 100 is used in this application.

As shown in FIG. 1, heating mat 100 generally includes means for securing and for providing positional stability of the heating mat 100 on a surface to be protected from snow and ice. Heating mat 100 may be secured in place in numerous ways including using stakes or fasteners 26 through grommets 108 located in a predetermined spaced-apart relationship along the respective side edges of the heating mat 100. In some applications, grommets 108 may be used as tie-offs where a cable, rope, or bungy cord 116 is connected at one end to a grommet 108 and the other end is tied-off to a structure such as a nearby landscape structure or a part of the house, including under the eave of a roof edge.

FIG. 1 depicts two parallel heating mats 100 installed on a driveway. These heating mats 100 may be about 3 feet wide each with the length to suit the length of the driveway.

Although not required, the heating mat 100 may include a thermal cutout switch 70 electrically connected in series with the flexible electric heater 10. It is preferable to eliminate or minimize any chances of an inadvertent shock, that an equipment leakage circuit interrupter-ELCI (or a ground fault circuit interrupter-GFCI) 134 be electrically connected in series with the flexible electric heater 10, the interrupter 134 being specifically located in an electrical power supply cable 60 for connecting the heating mat to a source 160 of electrical power with electrical plug 136. The ELCI device is typically used in circuits rated at greater than 30 amps and works in the same manner as the GFCI would for lower amperage circuits.

Figures 3A, 3B:
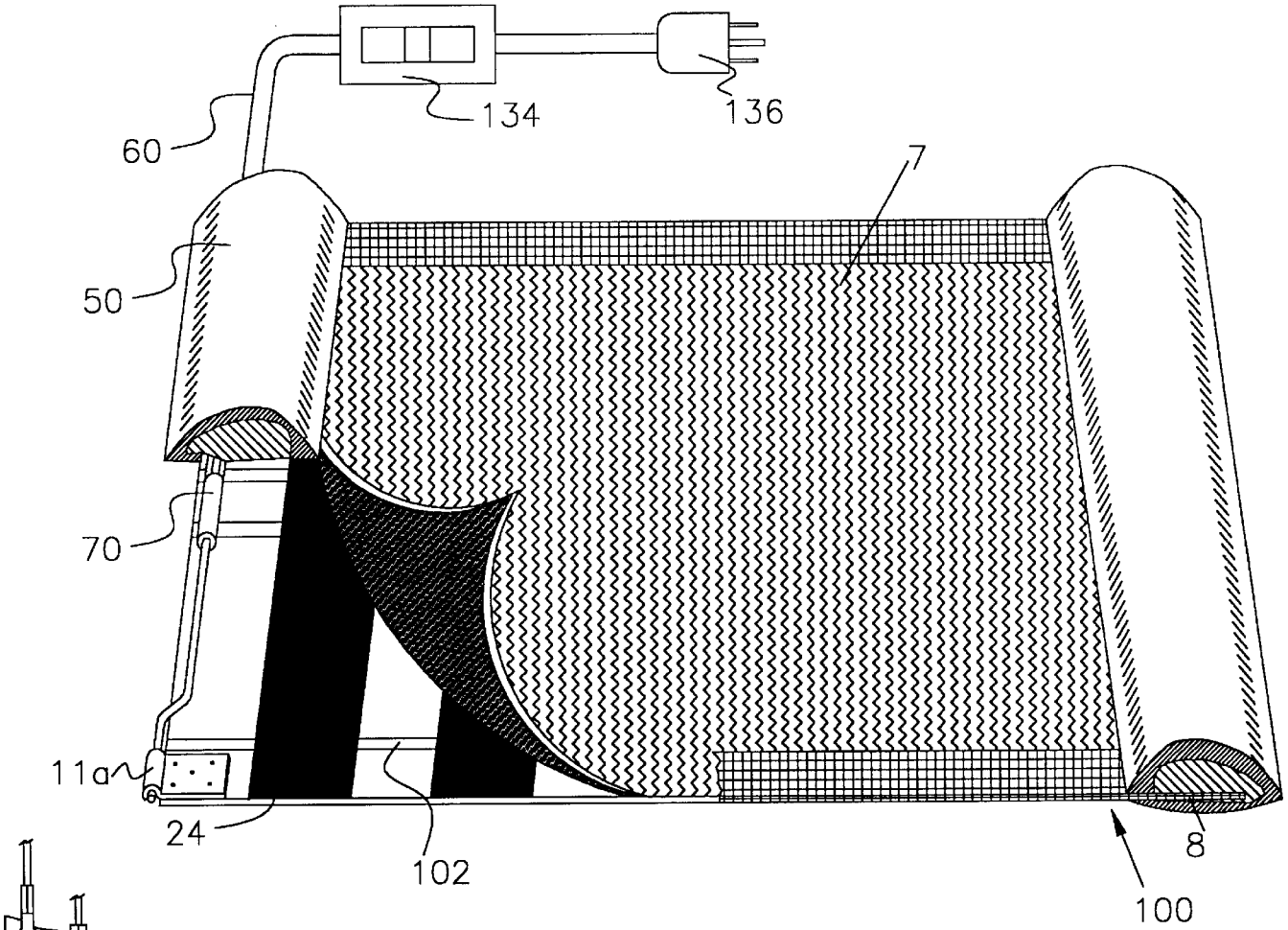
FIG. 3*a* is an expanded detail view of the invention's electrical end.
FIG. 3*b* depicts an alternative typical application of the use of an eyelet electrical terminal spade to make a terminal connection.

As shown on FIG. 3*a*, the heating mat 100 preferably has two opposing side edges which are bound by stitching an elongate substantially or generally water and mildew resistant material 140 to each of said opposing side edges. This is typically a two inch wide durable nylon web material, although it may be made from cotton, polyester or similar web materials. Although the web material is a preferred method of finishing the edges, an alternative method may include adhesively applying elastomeric or rubber based channels similar to those found in some industrial rubber backing carpets used for building entry ways.

The first and second insulating substrates 12,14 are typically made from a thermoplastic laminate material.

An elongated sealing bracket 50 having a substantially U-shaped cross section forming an elongated opening is dimensioned to receive each of the opposing end edges of the heating mat 100. The bracket 50 protects the opposing end edges and the electrical connections at each opposing end edges for connecting the flexible electric heater 10 to a source of electric power 160.

Figure 7:
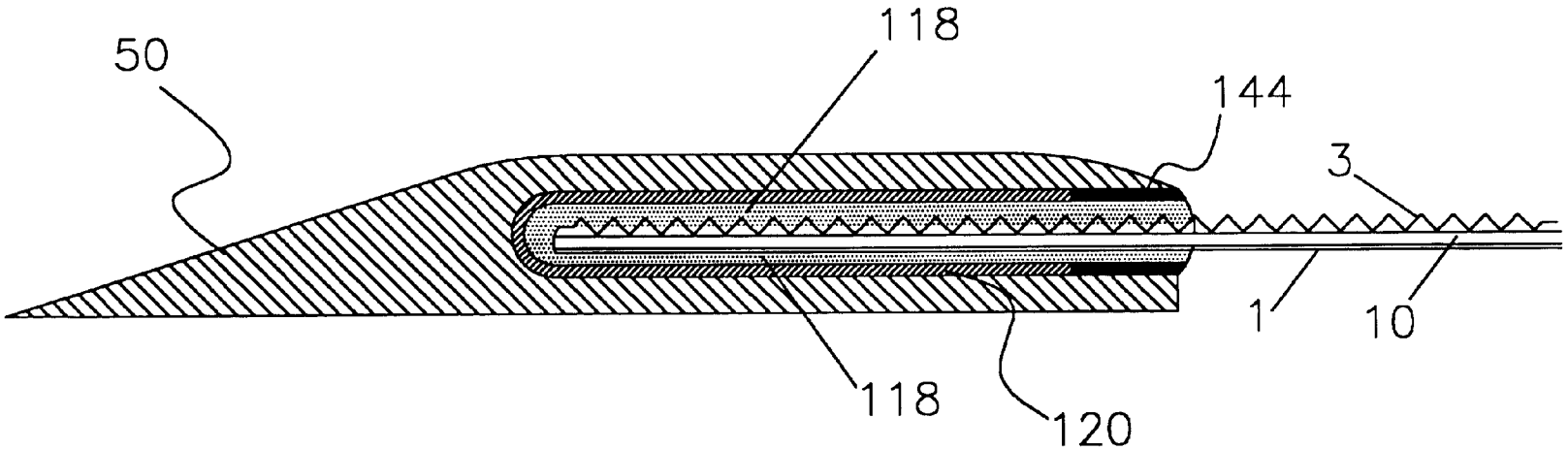
FIG. 7 is a cross-sectional view of an end of the invention.

The elongated sealing bracket 50 is typically attached with sealing means for bonding each end edge of the heating mat 100 and for encapsulating each end edge thereby preventing submersion, exposure from weather hazards, and injury due to electrocution. As shown in FIG. 2*b*, this is typically accomplished by applying a pressure sensitive hot melt adhesive 118 at an exposed end where the terminal connections are made, then generally wrapping the end edge with a butyl rubber based adhesive tape material 120, and then installing bracket 50 over the end encapsulating the terminals and adhesive tape 120. The inside edges of the bracket 50 is preferably coated with a tar like adhesive sealant 144. FIG. 7 depicts a cross-sectional view of bracket 50 with hot melt adhesive 118, butyl rubber adhesive tape 120 and sealant 144. It is then placed in a press to compress the bracket 50 to ensure a properly fitted and sealed end of the heating mat 100.

Figure 15:
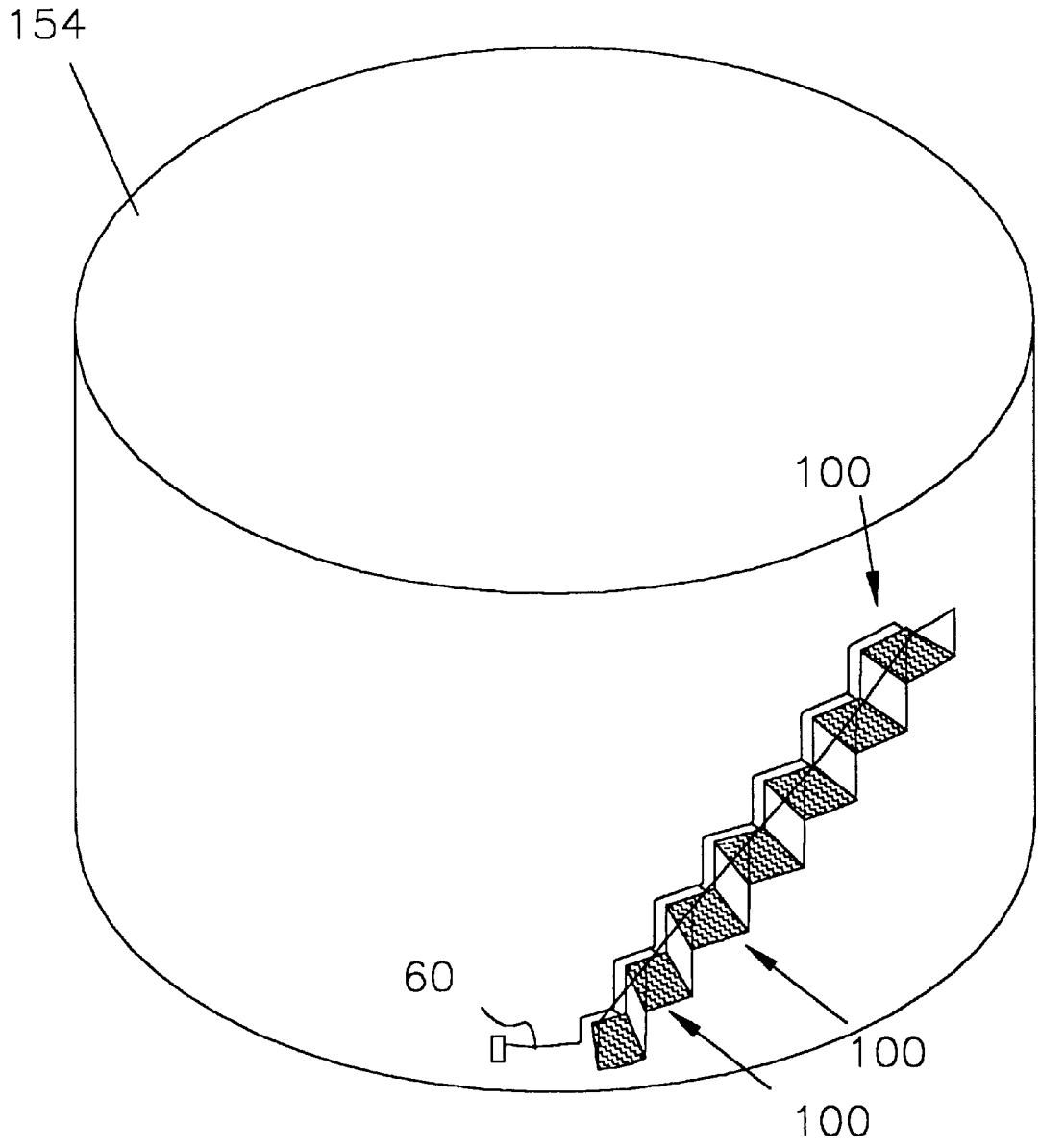
FIG. 15 is a schematic view depicting a typical application of the invention on staggered steps around the perimeter of a storage tank.

Although a power cord 60 may run directly from the side edge of the bracket 50, it is preferable that electrical connectors similar to that depicted as 130*a* and 130*b* be prewired into the edge of the bracket 50. As a convenience to installing the heating mat 100 in areas where the source of electrical power 160 may vary, it is recommended that respective male and female electrical connectors 130*a*,130*b* be prewired at both ends of the heating mat 100. This will facilitate interconnecting parallel mats 100 such as the two driveway mats 100 depicted in FIG. 1, or for connecting staggered or sequentially laid mats 100 such as the walkway mat 100 being electrically connected to the end of one of the driveway mats 100 as depicted in FIG. 1 or the staggered step use as depicted in FIG. 15 where mats 100 are installed on steps around a tank 154.

Figure 5:
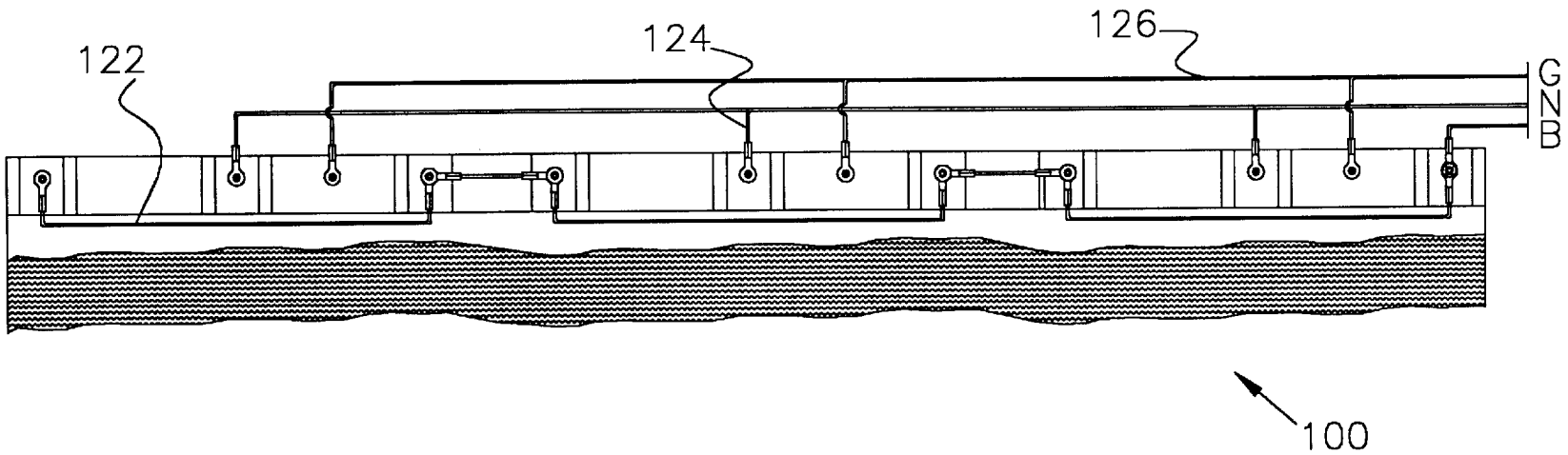
FIG. 5 is a typical application of three electric heaters in parallel to form a wide heating mat.

While a heating mat 100 for use on a roof edge may be made with a heater 10 which is about one foot wide, it is possible to make heating mats significantly wider, including 2–8 feet wide for driveways and walkways. In these situations, when an approximate three foot wide heating mat is manufactured, three heaters 10 may be arranged in parallel as depicted in FIG. 5 as an example, and then sandwiched into two single protective sheets 1,3 to form an approximate three foot wide heating mat 100. To obtain a two foot wide mat 100, a four foot wide mat 100, etc., would just require a corresponding number of one foot wide heaters 10 sandwiched between the protective sheets 1,3. In this way, a manufacturer need only use a one size width heater 10 to manufacture almost any width mat 100. Of course, it is within the scope of the present invention to use a single width heater 10 that corresponds to an approximate equal width mat 100.

Figure 12:
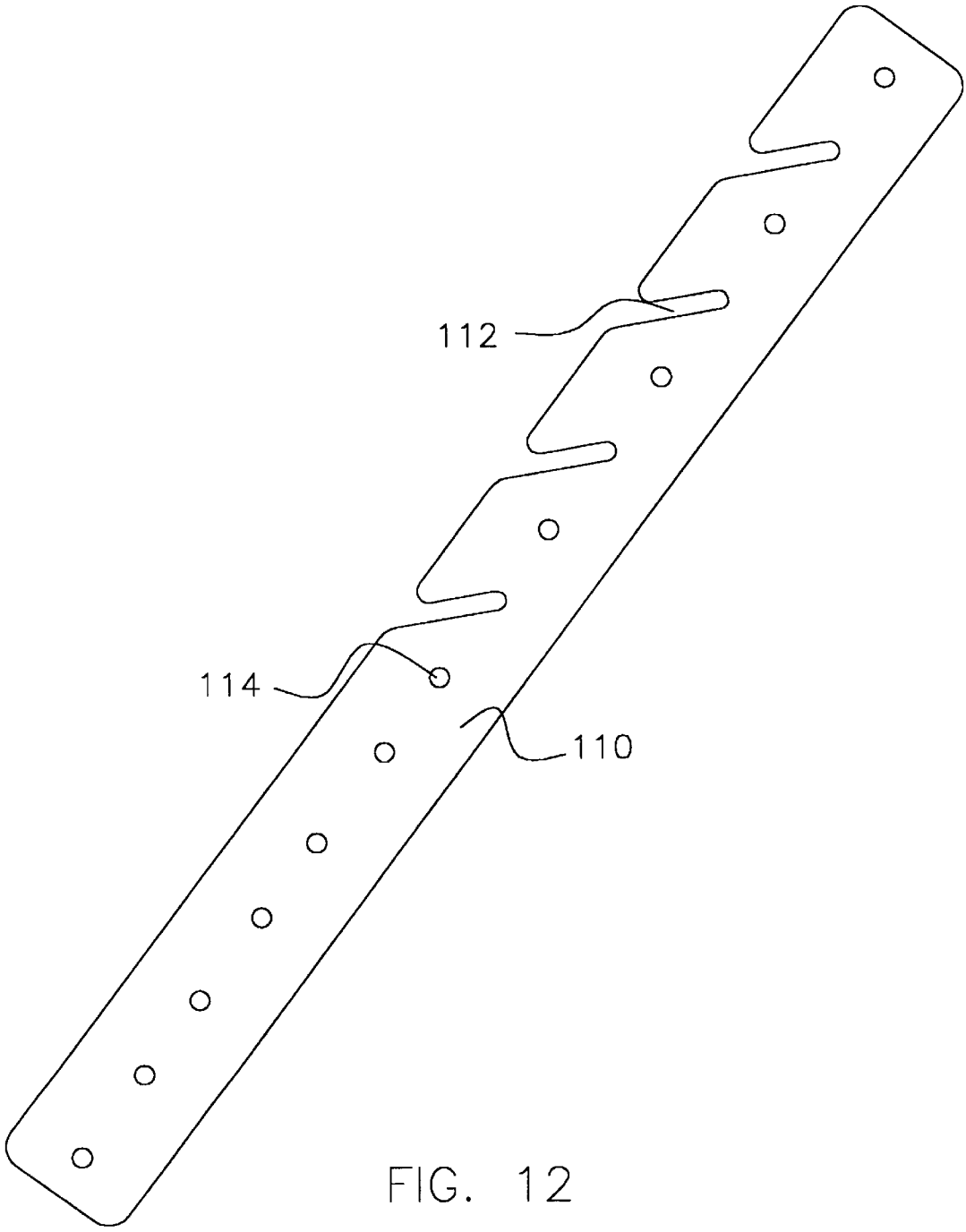
FIG. 12 is a perspective view of a typical application of the heating mat roof attachment means.
Figure 13B:
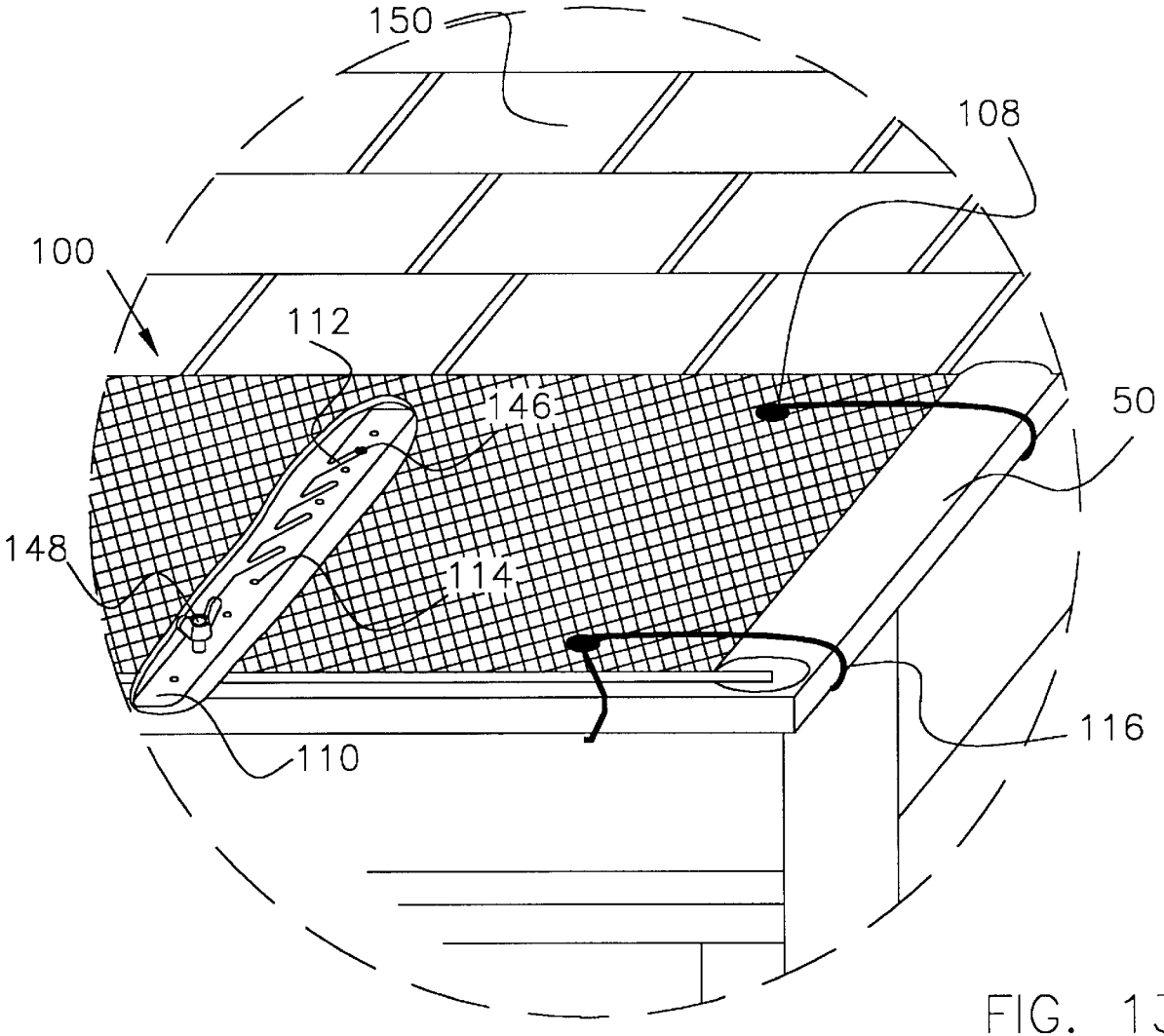
FIG. 13*b* is an exploded view of the use of the strap of FIG. 12 to secure the invention on a roof.

When installing heating mat 100 on a roof edge, one typical application of installing the mat 100 is shown in FIGS. 12, 13*a* and 13*b* includes the use of at least one elongate metallic strap 110 having a plurality of spaced-apart angularly directed slots 112, each strap 110 being of sufficient length for sliding said strap under roofing shingles 150 to engage a roof shingle nail 146 into one of the slots 112. Each strap 110 further includes a plurality of apertures 114 in a spaced-apart relationship along the length of said strap 110, wherein the heating mat 100 may be attached to the strap 110 by placing a fastener 148, such as a bolt and wing nut, through one of the apertures 114 and into one of the grommets 108, thereby securing the heating mat 100 in place, along roof edge 162 of building 164.

As mentioned above, when securing a heating mat 100 on a roof edge, one or more elastomeric straps 116, similar to bungy cords, with connecting means at each end for connecting the strap 116 to one of the grommets 108 and for connecting an opposite end of the strap 116 to a predetermined portion of the building near the roof edge.

Figure 4A:
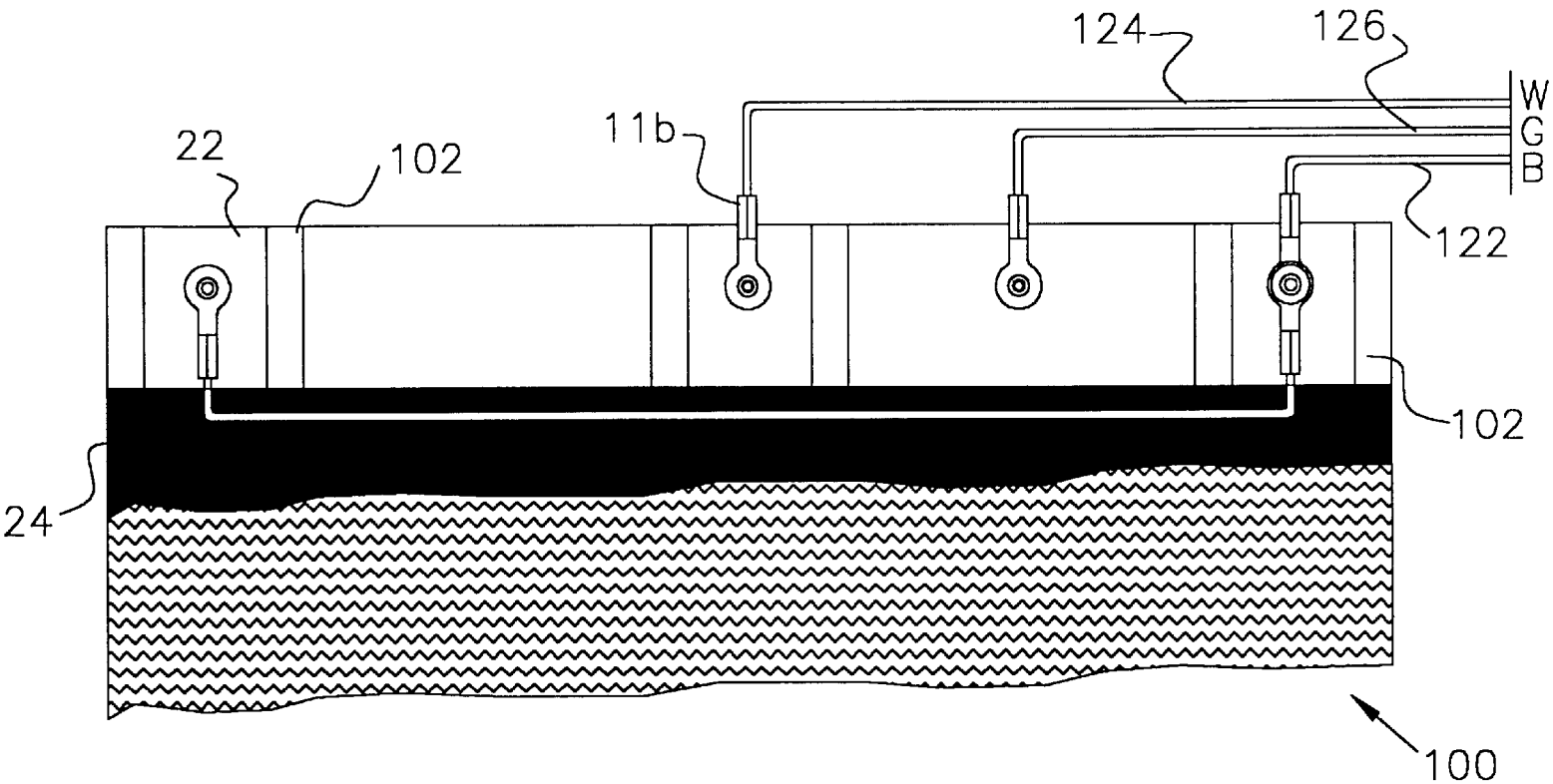
FIG. 4*a* depicts a typical wiring connection for a 110-volt circuit.
Figure 4B:
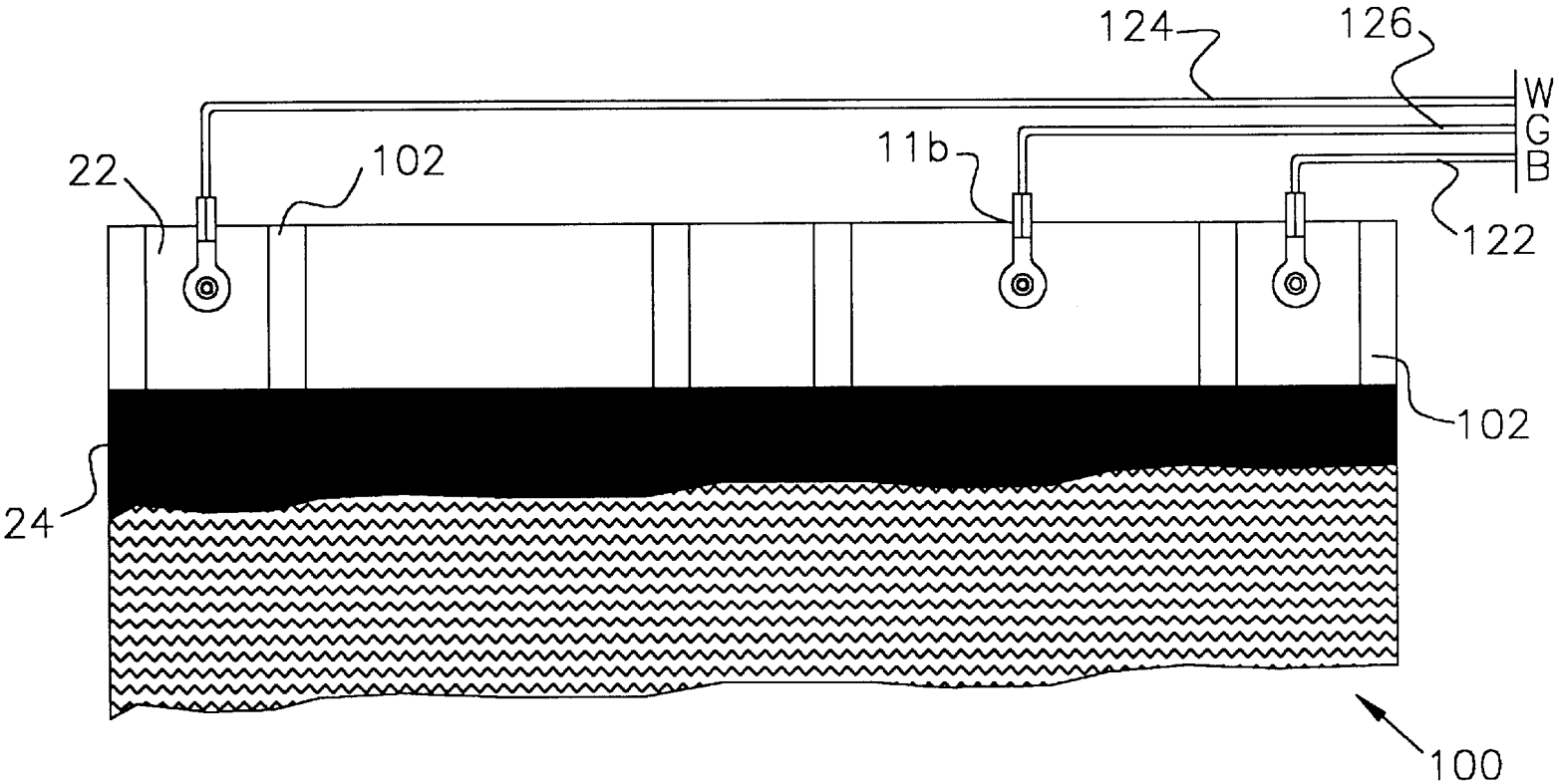
FIG. 4*b* depicts a typical wiring connection for a 220-volt circuit.

FIGS. 4*a* and 4*b* depicts respective typical wiring diagrams for a 110 volt and a 220 volt connection. In the 110 volt heating mat 100 connection, white (W) wire 124 or generally called the neutral wire, is connected to the intermediate conductor 22; and black (B) wire 122 or the positive power wire is connected to one of the edge conductors 22 which in turn is connected to the opposite edge conductor 22. Green (G) wire or the ground wire 126 is then connected to the aluminum grounding substrate 104. In the 220 volt connection, the neutral wire 124 is connected to one edge conductor 22 and the positive wire 122 is connected to the opposite edge conductor 22 as shown in FIG. 4*b*. Although there are numerous methods of making the terminal connections, preferred examples are shown in FIGS. 3*a*, 3*a*, 4*a* and 4*b*. In these depictions, bite-type compression amp terminal fittings 11*a* or eyelet type barrel terminal fittings 11*b* are used. The bite-type fittings 11*a* provide for more effective and reliable contact.

Figure 6:
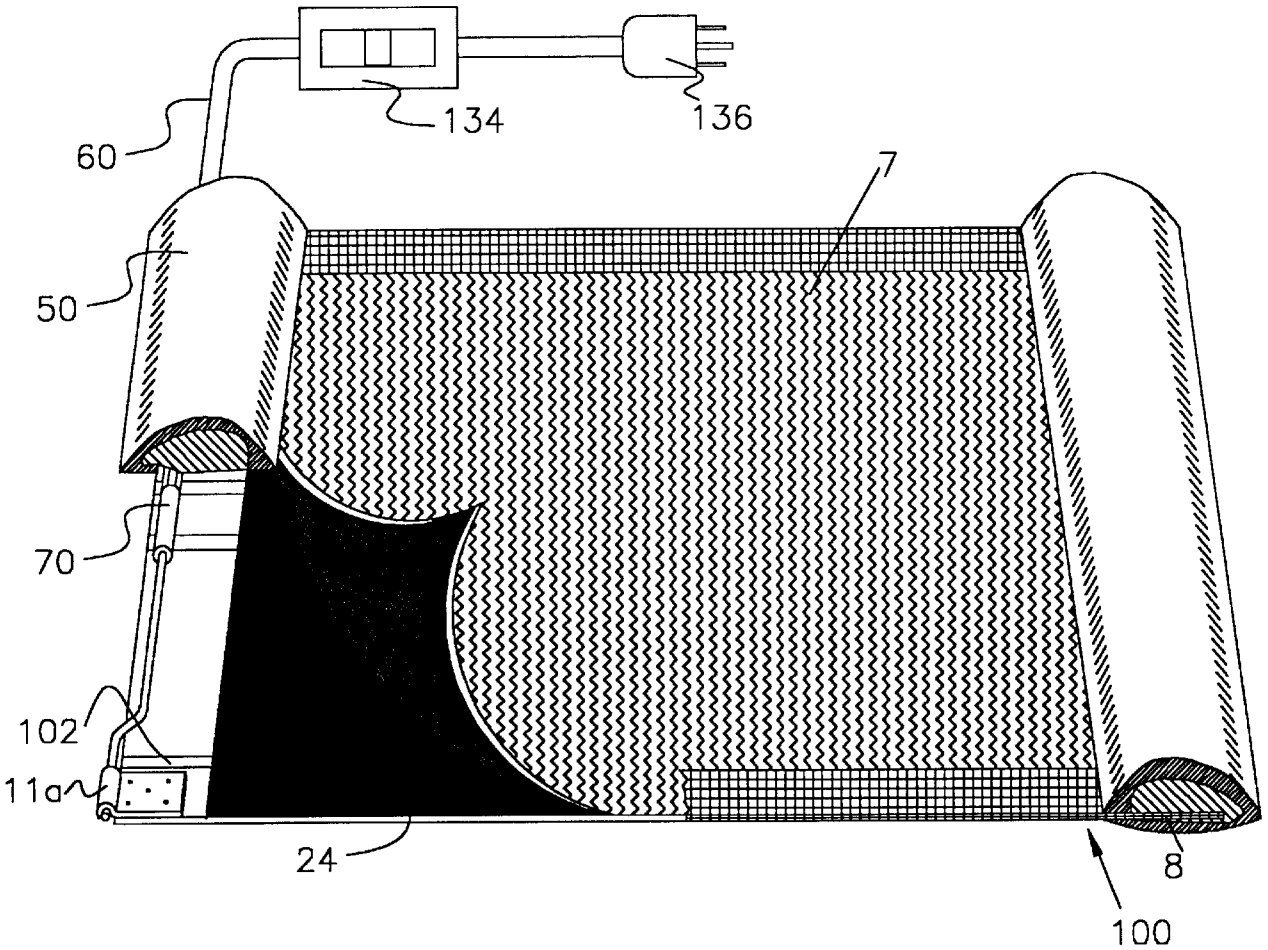
FIG. 6 depicts the heating mat of FIG. 3*a*, except with the uniform layer of resistive material traces.

FIG. 5 described above further depicts a typical 110 volt wiring scheme for using three heaters 10 to form a single heating mat 100. FIG. 6 is intended to point out that in lieu of a plurality of parallel resistive material traces as depicted FIG. 3*a*, an alternative heater 10 may incorporate a uniform layered resistive heating element 24 comprising a generally uniform layer of resistive material traces 24 deposited on the first insulating substrate 12. Otherwise the remaining structural components remain the same as previously described.

Figures 8A, 9A:
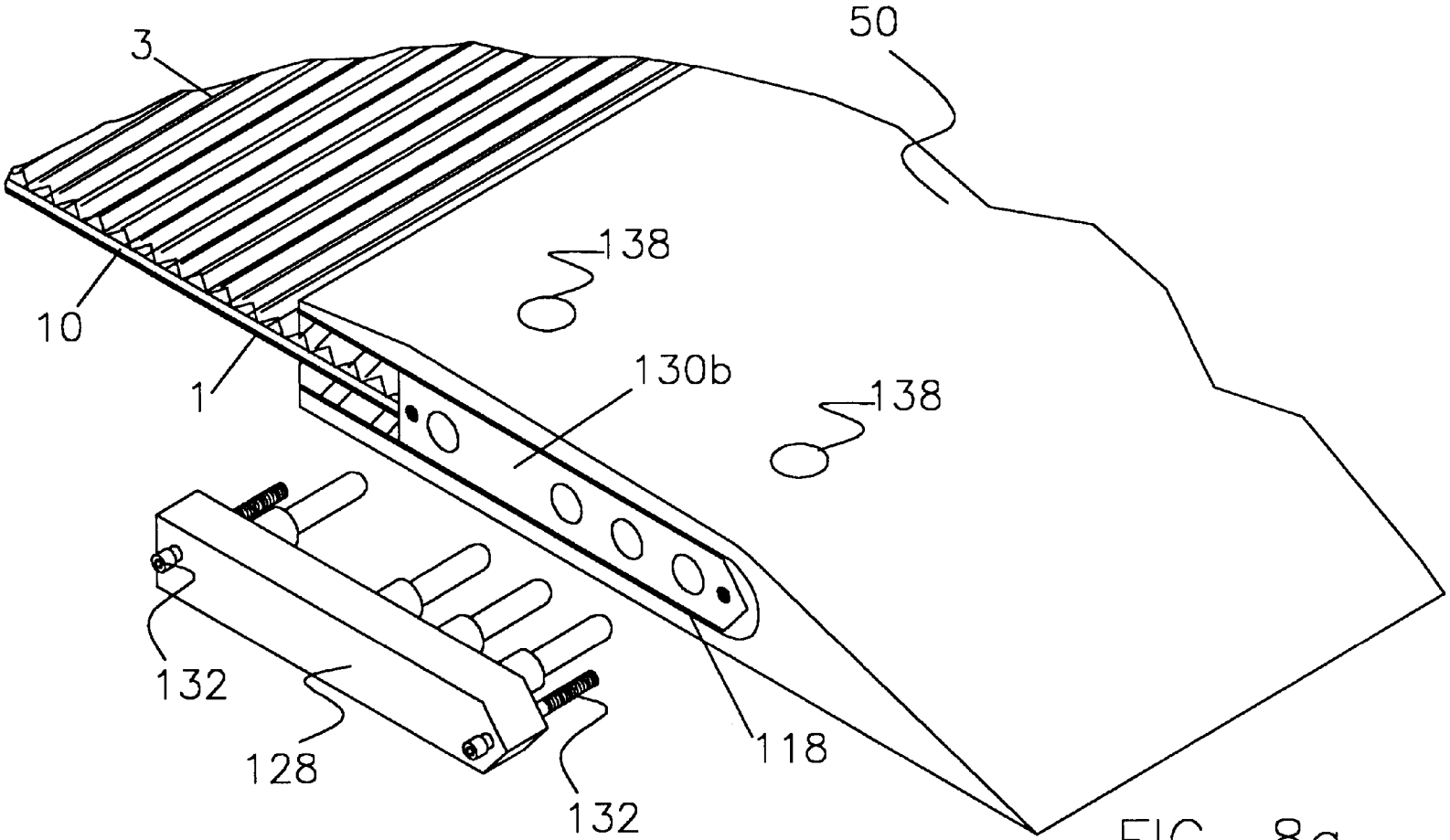
FIG. 8*a* is a perspective view of a typical application of the use of a female electrical connector at an end of the heating mat.
FIG. 9*a* is a perspective view of a temporary male dummy plug for use with the female electrical connector depicted in FIG. 8*a;*
Figures 8B, 9B:
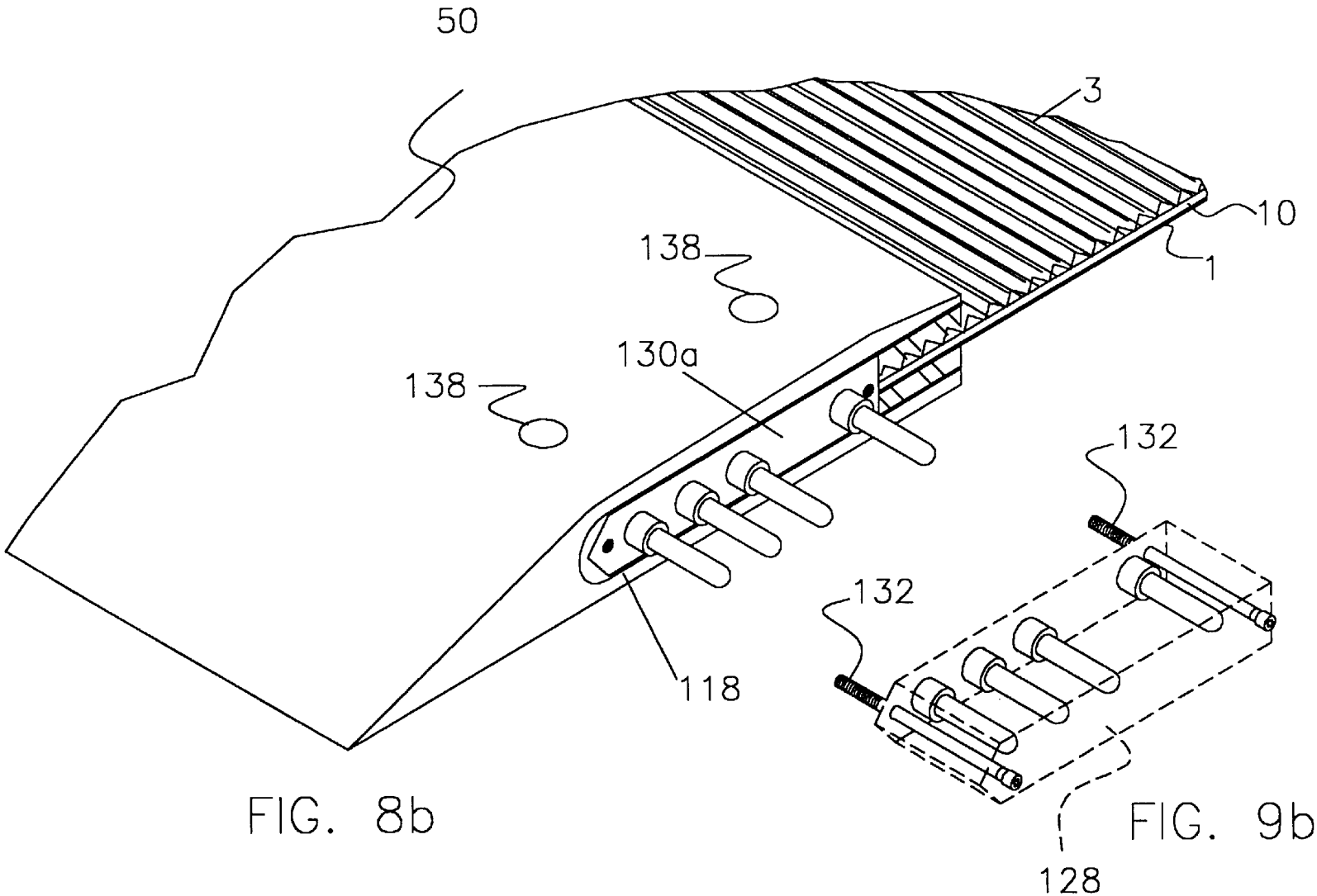
FIG. 8*b* is a perspective view of a typical application of the use of a male electrical connector at an end of the heating mat.
FIG. 9*b* is a perspective view of a temporary female dummy plug for use with the male electrical connector depicted in FIG. 8*b;*

FIGS. 8*a* and 8*b* show respective female and male electrical connectors 130*b*,130*a* incorporated into the bracket 50 edges. In a practical application, it is recommended that rivet or strain relief apertures 138 be included in bracket 50 so that securing screws may be optionally inserted from the top surface of bracket 50 into the body of electrical connectors 130*a*,130*b*. To weather protect the unused connectors 130*a*, 130*b* when mat 100 is used and electrically powered, it is recommended that dummy plugs and receptacles 128 be used, as shown in FIGS. 9*a* and 9*b*. It is further recommended that fasteners 132 be used to secure plugs and receptacles 128 to corresponding connectors 130*a*,130*b*. This method of fastening is similar to that used when fastening computer cables to the back of a computer.

Figure 14:
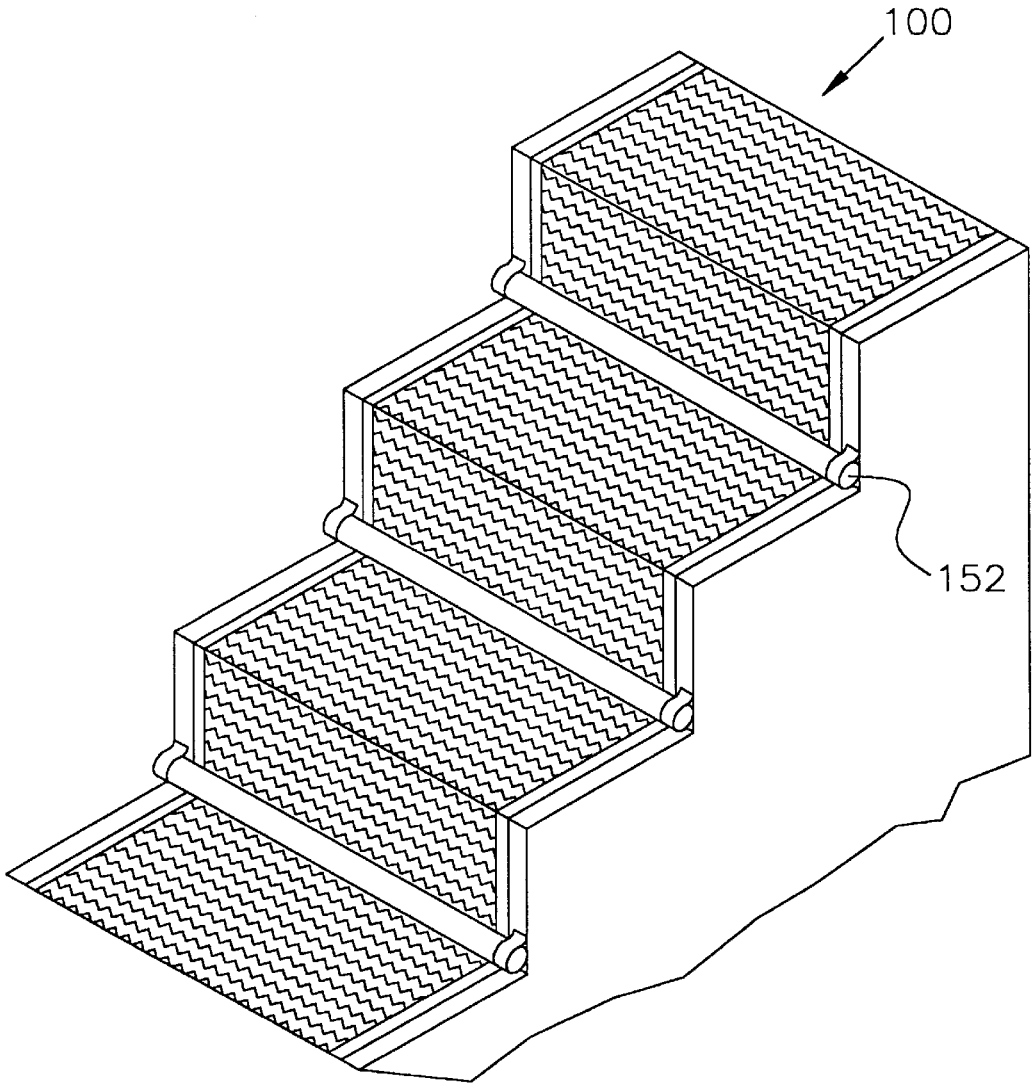
FIG. 14 is a perspective view depicting a typical application of the invention on a stairway.

FIG. 14 is another application of the invention where heating mat 100 is laid down a set of steps. In this application, the mat 100 may be secured by using the grommets 108 as previously described or by using rods fasteners 152 similar to that used for installing carpets on stairways.

Figure 16:
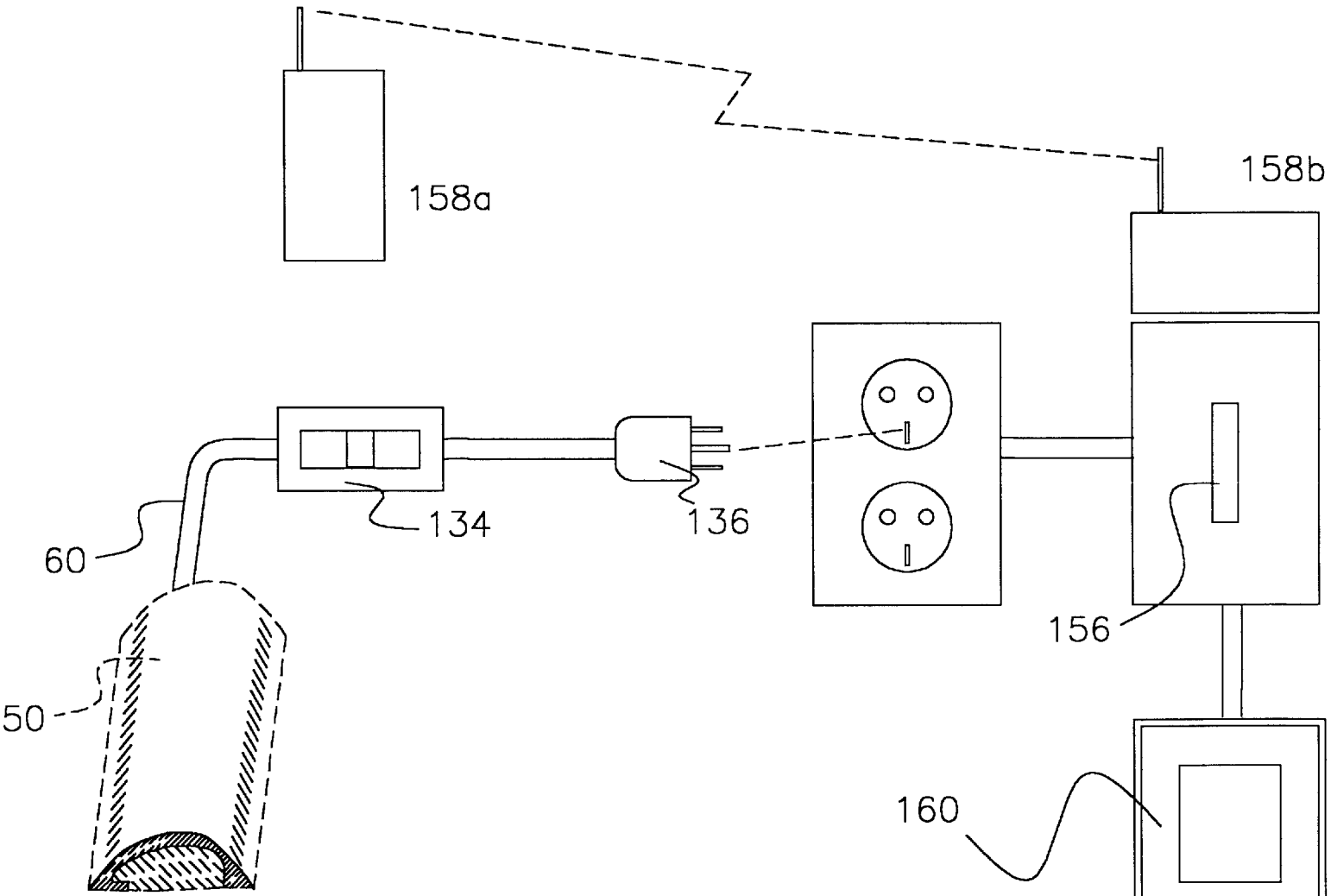
FIG. 16 is a schematic diagram depicting the manual and remote electrical activation features of the invention.

FIG. 16 is a schematic diagram depicting a manual and/or remote electrical activation feature of the present invention. In the manual activation feature, an individual may just manually switch at inline switch 156 the power "on" to activate the circuit or "off" to deactivate the circuit. In the remote activation feature, an individual may send a transmitted radio frequency signal from transmitter 158*a* to receiver 158*b* which can then by-pass a switch 156 to electrically activate or deactivate the circuit. The relays and contacts necessary to by-pass the switch 156 are not shown but such circuitry is well known in the art.

As seen from the foregoing description, the present invention satisfies a long felt need to provide a useful device which is convenient to use for snow melting and ice melting.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A heating mat for melting snow and ice comprising:

at least one planar flexible electric heater;

the at least one planar flexible electric heater including a first elongated, flexible, electrically insulating substrate having an electrically insulated surface;

the at least one planar flexible electric heater further including a plurality of resistive heating elements comprising a plurality of resistive material traces deposited on said first insulating substrate in spaced apart relationship, a first and second electrical conductors, each disposed in proximity to each of respective opposing edges of said electric heater and a third electrical conductor disposed at an intermediate location between the first and second electrical conductors, each of said resistive material traces being in electrical communication with the first, second and third electrical conductors and extending therebetween;

the at least one planar flexible heater further including a second elongated, flexible, electrically insulating substrate having an electrically insulated surface, wherein the first insulating substrate is adhesively attached to the second insulating substrate with the resistive heating elements and electrical conductors disposed therebetween, the first insulating substrate and the second insulating substrate forming the at least one flexible electric heater's two opposite planar surfaces; and two protective sheets composed of abrasion resistant flexible material, each having an inner surface oriented towards and in face to face adherent engagement with the respective planar surfaces of the at least one flexible electric heater, said two protective sheets and said electric heater disposed therebetween forming the heater mat having two opposing end edges, and two opposing side edges, wherein the resistive heating traces and electrical conductors are arranged such that a portion of the heating mat may be removed to accommodate a use by cutting the heating mat to remove said portion, the heating mat being adapted to maintain its electrical operative characteristics after removal of said portion.

2. The heating mat according to claim 1, wherein the at least one planar flexible heater further includes a grounding metallic substrate in a laminar relationship with the first insulating substrate, wherein the grounding metallic substrate is adhesively attached to the first insulating substrate.

3. The heating mat according to claim 1, wherein each of the first, second and third electrical conductors is an elongate strip comprising one of copper and copper alloys.

4. The heating mat according to claim 1, wherein the planar flexible electric heater further includes an elongate conductive film disposed between each of the first, second and third electrical conductors and the first insulating substrate, the elongate conductive film comprising one of silver and silver alloys.

5. The heating mat according to claim 1, wherein the respective inner surfaces of said protective sheets are bonded onto respective planar surfaces of the electric heater with a pressure sensitive hot melt adhesive.

6. The heating mat according to claim 1, wherein at least one of said protective sheets includes an outer surface with a nonskid pattern impressed thereupon.

7. The heating mat according to claim 6, wherein the nonskid pattern includes a plurality of ribs protruding therefrom, the ribs forming a cyclic V-pattern extending transversely to the side edges of the heating mat and the ribs further forming drainage channels in the spaces therebetween.

8. The heating mat according to claim 1, further comprising a thermal cutout switch electrically connected in series with said at least one flexible electric heater.

9. The heating mat according to claim 1, further comprising one of a ground fault circuit interrupter or an equipment leakage circuit interrupter electrically connected in series with the at least one flexible electric heater, the one of the ground fault circuit interrupter or the equipment leakage circuit interrupter being located in an electrical power supply cable for connecting the heating mat to a source of electrical power.

10. The heating mat according to claim 1, wherein the two opposing side edges of the heating mat are bound by stitching an elongate generally water and mildew resistant material to each of said opposing side edges.

11. The heating mat according to claim 1, wherein the first and second insulating substrates are made from a thermoplastic laminate material.

12. The heating mat according to claim 1, further comprising an elongated sealing bracket having a substantially U-shaped cross section forming an elongated opening dimensioned to receive each of the opposing end edges of said heating mat within said opening for protecting said opposing end edges and for protecting electrical connections at each opposing end edges for connecting the at least one flexible electric heater to a source of electric power.

13. The heating mat according to claim 12, wherein the elongated sealing bracket is attached with sealing means for bonding each end edge of the heating mat and for encapsulating each end edge thereby preventing submersion, exposure from weather hazards, and injury due to electrocution.

14. The heating mat according to claim 12, further comprising means for connecting the source of electric power from either side edge of the elongated sealing bracket protecting the electrical connections.

15. The heating mat according to claim 1, wherein the at least one planar flexible electric heater comprises two planar flexible electric heaters in parallel with each other.

16. The heating mat according to claim 1, wherein the at least one planar flexible electric heater comprises three planar flexible electric heaters in parallel with each other.

17. The heating mat according to claim 1, wherein the at least one planar flexible electric heater comprises four planar flexible electric heaters in parallel with each other.

18. The heating mat according to claim 1, wherein the at least one planar flexible electric heater comprises five planar flexible electric heaters in parallel with each other.

19. The heating mat according to claim 1, wherein at least one of the two protective sheets is reinforced by one of fibrous or woven material, embedded therein.

20. The heating mat according to claim 1, further comprising means for securing and for providing positional stability of the heating mat on a surface to be protected from snow and ice.

21. The heating mat according to claim 20, wherein the means for securing and providing positional stability of the heating mat on a surface to be protected from snow and ice includes a plurality of grommets located in a predetermined spaced-apart relationship along the respective side edges of the heating mat.

22. The heating mat according to claim 21, wherein when a heating mat is to be located on a roof edge, the means for securing and providing positional stability of the heating mat on a surface to be protected from snow and ice further comprises:

at least one elongate metallic strap having a plurality of spaced-apart angularly directed slots, each strap being of sufficient length for sliding said strap under a roofing shingles and to engage a roof shingle nail into one of said slots; and each strap further including a plurality of apertures in a spaced-apart relationship along the length of said strap, wherein the heating mat may be attached to the strap by placing a fastener through one of said apertures into one of said grommets, thereby securing the heating mat in place.

23. The heating mat according to claim 22, wherein when a heating mat is to be located on a roof edge, the means for securing and providing positional stability of the heating mat on a surface to be protected from snow and ice further comprises:

at least one elastomeric strap with connecting means at each end for connecting one end of said strap to one of said grommets and for connecting an opposite end of said strap to a predetermined portion of a building near the roof edge.

24. The heating mat according to claim 1, wherein the heating mat may be electrically connected with one or more heating mats for use on steps and other staggered surfaces.

25. The heating mat according to claim 14, further comprising means to remotely electrically activate and electrically deactivate the heating mat.

26. The heating mat according to claim 14, further comprising means to manually electrically activate and electrically deactivate the heating mat, the means comprising an inline switch between the heating mat and the source of electric power.

27. The heating mat according to claim 9, further including means to remotely electrically activate and electrically deactivate the heating mat, the means including a Radio Frequency signal receiver connected between the equipment leakage circuit interrupter and the source of electric power, the signal receiver receiving a signal from a Radio Frequency transmitter remotely located from the heating mat.

28. The heating mat according to claim 9, further comprising means to manually electrically activate and electrically deactivate the heating mat, the means comprising an inline switch between the one of the ground fault circuit interrupter or the equipment leakage circuit interrupter and the source of electric power.

29. A heating mat for melting snow and ice comprising:

at least one planar flexible electric heater;

the at least one planar flexible electric heater including a first elongated, flexible, electrically insulating substrate having an electrically insulated surface;

the at least one planar flexible electric heater further including a uniform layered resistive heating element comprising a generally uniform layer of resistive material traces deposited on said first insulating substrate, a first and second electrical conductors, each disposed in proximity to each of respective opposing edges of said electric heater and a third electrical conductor disposed at an intermediate location between the first and second electrical conductors, the resistive material traces being in electrical communication with the first, second and third electrical conductors and being in an underlying relationship;

the at least one planar flexible heater further including a second elongated, flexible, electrically insulating substrate having an electrically insulated surface, wherein the first insulating substrate is adhesively attached to the second insulating substrate with the resistive heating element and electrical conductors disposed therebetween, the first insulating substrate and the second insulating substrate forming the at least one flexible electric heater's two opposite planar surfaces; and two protective sheets composed of abrasion resistant flexible material, each having an inner surface oriented towards and in face to face adherent engagement with the respective planar surfaces of the at least one flexible electric heater, said two protective sheets and said electric heater disposed therebetween forming the heater mat having two opposing end edges, and two opposing side edges, wherein the resistive heating traces and electrical conductors are arranged such that a portion of the heating mat may be removed to accommodate a use by cutting the heating mat to remove said portion, the heating mat being adapted to maintain its electrical operative characteristics after removal of said portion.

30. The heating mat according to claim 29, wherein the at least one planar flexible heater further includes a grounding metallic substrate in a laminar relationship with the first insulating substrate, wherein the grounding metallic substrate is adhesively attached to the first insulating substrate.

31. The heating mat according to claim 29, wherein each of the first, second and third electrical conductors is an elongate strip comprising one of copper and copper alloys.

32. The heating mat according to claim 29, wherein the planar flexible electric heater further includes an elongate conductive film disposed between each of the first, second and third electrical conductors and the first insulating substrate, the elongate conductive film comprising one of silver and silver alloys.

33. The heating mat according to claim 29, wherein the respective inner surfaces of said protective sheets are bonded onto respective planar surfaces of the electric heater with a pressure sensitive hot melt adhesive.

34. The heating mat according to claim 29, wherein at least one of sa id protective sheets includes an outer surface with a nonskid pattern impressed thereupon.

35. The heating mat according to claim 34, wherein the nonskid pattern includes a plurality of ribs protruding therefrom, the ribs forming a cyclic V-pattern extending transversely to the side edges of the heating mat and the ribs further forming drainage channels in the spaces therebetween.

36. The heating mat according to claim 29, further comprising a thermal cutout switch electrically connected in series with said at least one flexible electric heater.

37. The heating mat according to claim 29, further comprising one of a ground fault circuit interrupter or an equipment leakage circuit interrupter, electrically connected in series with the at least one flexible electric heater, the one of the ground fault circuit interrupter or the equipment leakage circuit interrupter being located in an electrical power supply cable for connecting the heating mat to a source of electrical power.

38. The heating mat according to claim 29, wherein the two opposing side edges of the heating mat are bound by stitching an elongate generally water and mildew resistant material to each of said opposing side edges.

39. The heating mat according to claim 29, wherein the first and second insulating substrates are made from a thermoplastic laminate material.

40. The heating mat according to claim 29, further comprising an elongated sealing bracket having a substantially U-shaped cross section forming an elongated opening dimensioned to receive each of the opposing end edges of said heating mat within said opening for protecting said opposing end edges and for protecting electrical connections at each opposing end edges for connecting the at least one flexible electric heater to a source of electric power.

41. The heating mat according to claim 40, wherein the elongated sealing bracket is attached with sealing means for bonding each end edge of the heating mat and for encapsulating each end edge thereby preventing submersion, exposure from weather hazards, and injury due to electrocution.

42. The heating mat according to claim 40, further comprising means for connecting the source of electric power from either side edge of the elongated sealing bracket protecting the electrical connections.

43. The heating mat according to claim 29, wherein the at least one planar flexible electric heater comprises two planar flexible electric heaters in parallel with each other.

44. The heating mat according to claim 29, wherein the at least one planar flexible electric heater comprises three planar flexible electric heaters in parallel with each other.

45. The heating mat according to claim 29, wherein the at least one planar flexible electric heater comprises four planar flexible electric heaters in parallel with each other.

46. The heating mat according to claim 29, wherein the at least one planar flexible electric heater comprises five planar flexible electric heaters in parallel with each other.

47. The heating mat according to claim 29, wherein at least one of the two protective sheets is reinforced by one of fibrous or woven material, embedded therein.

48. The heating mat according to claim 29, further comprising means for securing and for providing positional stability of the heating mat on a surface to be protected from snow and ice.

49. The heating mat according to claim 48, wherein the means for securing and providing positional stability of the heating mat on a surface to be protected from snow and ice includes a plurality of grommets located in a predetermined spaced-apart relationship along the respective side edges of the heating mat.

50. The heating mat according to claim 49, wherein when a heating mat is to be located on a roof edge, the means for securing and providing positional stability of the heating mat on a surface to be protected from snow and ice further comprises:

at least one elongate metallic strap having a plurality of spaced-apart angularly directed slots, each strap being of sufficient length for sliding said strap under a roofing shingles and to engage a roof shingle nail into one of said slots; and each strap further including a plurality of apertures in a spaced-apart relationship along the length of said strap, wherein the heating mat may be attached to the strap by placing a fastener through one of said apertures into one of said grommets, thereby securing the heating mat to the roof edge.

51. The heating mat according to claim 50, wherein when a heating mat is to be located on a roof edge, the means for securing and providing positional stability of the heating mat on a surface to be protected from snow and ice further comprises:

at least one elastomeric strap with connecting means at each end for connecting one end of said strap to one of said grommets and for connecting an opposite end of said strap to a predetermined portion of a building near the roof edge.

52. The heating mat according to claim 29, wherein the heating mat may be electrically connected with one or more heating mats for use on steps and other staggered surfaces.

53. The heating mat according to claim 42, further comprising means to remotely electrically activate and electrically deactivate the heating mat.

54. The heating mat according to claim 42, further comprising means to manually electrically activate and electrically deactivate the heating mat, the means comprising an inline switch between the heating mat and the source of electric power.

55. The heating mat according to claim 37, further including means to remotely electrically activate and electrically deactivate the heating mat, the means including a Radio Frequency signal receiver connected between the equipment leakage circuit interrupter and the source of electric power, the signal receiver receiving a signal from a Radio Frequency transmitter remotely located from the heating mat.

56. The heating mat according to claim 37, further comprising means to manually electrically activate and electrically deactivate the heating mat, the means comprising an inline switch between one of the ground fault circuit interrupter or the equipment leakage circuit interrupter and the source of electric power.

57. The heating mat according to claim 1, wherein at least one of said protective sheets is made from a roofing material.

58. The heating mat according to claim 57, wherein the roofing material is one of a roof shingle material and single coverage rolled roof material.

59. The heating mat according to claim 57, wherein the roofing material is colored to match standard roof coverage materials.

60. The heating mat according to claim 29, wherein at least one of said protective sheets is made from a roofing material.

61. The heating mat according to claim 60, wherein the roofing material is one of a roof shingle material and single coverage rolled roof material.

62. The heating mat according to claim 60, wherein the roofing material is colored to match standard roof coverage materials.

* * * * *